United States Patent [19]

Eubanks

[11] Patent Number: 4,630,710

[45] Date of Patent: Dec. 23, 1986

[54] ELEVATABLE WORK STATION

[76] Inventor: Furney M. Eubanks, Rte. 2, Box 361, Trenton, N.C. 28585

[21] Appl. No.: 732,189

[22] Filed: May 9, 1985

[51] Int. Cl.[4] ..... E06C 7/12; E04G 3/10

[52] U.S. Cl. ..... 182/116; 182/145; 182/102

[58] Field of Search ..... 182/142, 143, 144, 35, 182/33, 28, 102, 101, 116, 145

[56] References Cited

U.S. PATENT DOCUMENTS

| | | | |
|---|---|---|---|
| 264,577 | 9/1882 | Smith | 182/144 |
| 391,854 | 10/1888 | Noll | 182/144 |
| 731,708 | 6/1903 | Quinn | 182/102 |
| 738,164 | 9/1903 | Cody | 182/102 |
| 859,266 | 7/1907 | Ulery | 182/233 |
| 1,198,122 | 9/1916 | Golden | 182/142 |
| 1,453,227 | 4/1923 | Murray | 182/147 |

*Primary Examiner*—Reinaldo P. Machado
*Attorney, Agent, or Firm*—Mills & Coats

[57] ABSTRACT

This invention is a self-hoisting platform which can be used by painters, carpenters, or the like when painting or repairing elevated building structures. This is accomplished through the provision of a seat-like means having an interconnected dual lift system with reversible, pawl type locking means for manually raising and lowering the system.

11 Claims, 6 Drawing Figures

ELEVATABLE WORK STATION

FIELD OF INVENTION

This invention relates to work stations and more particularly to lift means for work stations.

BACKGROUND OF INVENTION

Since mankind first began to build free standing structures, there has been a problem in painting, repairing, cleaning windows and the like of such structures, particularly, in the more elevated areas. Scaffolds of one type or another have, of course, been erected for workers to stand on as well as ladders of various types.

Each of the elevated work stations, however, have their own particular or peculiar disadvantages. Scaffolds require extra effort to move once the work in the area surrounding the same has been completed. The higher the work area, the more complicated it is to move the scaffolding and the more likely a mishap or accident may occur during both the work and the moving stages.

There are two types of ladders that have been developed over the years, step ladders which are self standing and regular or extension ladders which rely on a separate structure for support. In either case, the area of work extends only out as far as the workmen can reach and must be moved frequently because of this. Also, the larger the ladder, the more difficult it is to move because of its height and weight.

To summarize the prior art, it has been difficult to put in place and move scaffold-type like elevated work stations while ladder elevating means have limited work area before movement is required thus, although they are easier to move, they must be moved more often. Both elevating means are laborious to use but up until now have been a necessary evil that workmen have put up with.

BRIEF DESCRIPTION OF INVENTION

After much research and study into the above mentioned problems, the present invention has been developed to provide an elevated work station that is as easily set up and moved as a conventional or extension type ladder and yet allows the worker to cover an area as large or larger than the average scaffold.

The above is accomplished through the provision of a unique pulley and winch system which allows the worker, while in a sitting position, to move from an area adjacent the structure/ladder support juncture to the ground in any desired increments of movement with the simple rotation of a pair of opposed controlled wheels. Safety mechanisms are also provided to prevent unintentional lowering of the work station.

The present invention is almost as simple to set up as a ladder and much simpler to set up then a scaffold and yet covers considerable more work area than a ladder and either approaches or surpasses the work area available from a scaffold.

In view of the above, it is an object of the present invention to provide an elevated work station that is as easily moved as a conventional ladder while exposing a work area equal to that exposed to his scaffold.

Another object of the present invention is to provide a pulley and winch system for raising and lowering an elevated work station.

Another object of the present invention is to provide a moveable work station which travels vertically from a location adjacent the eves of a structure to the ground therebelow.

Another object of the present invention is to provide safety mechanisms for hand operated pulley and winch supported work station.

Another object of the present invention is to provide a work station wherein the user thereof is in a sitting position.

Another object of the present invention is to provide a work station which is supported by a pulley and winch system operated by relatively large hand wheels.

Other objects and advantages of the present invention will become apparent and obvious from a study of the following description and the accompanying drawings which are merely illustrative of such invention.

BRIEF DESCRIPTION OF INVENTION

DETAILED DESCRIPTION OF INVENTION

Figure 2:
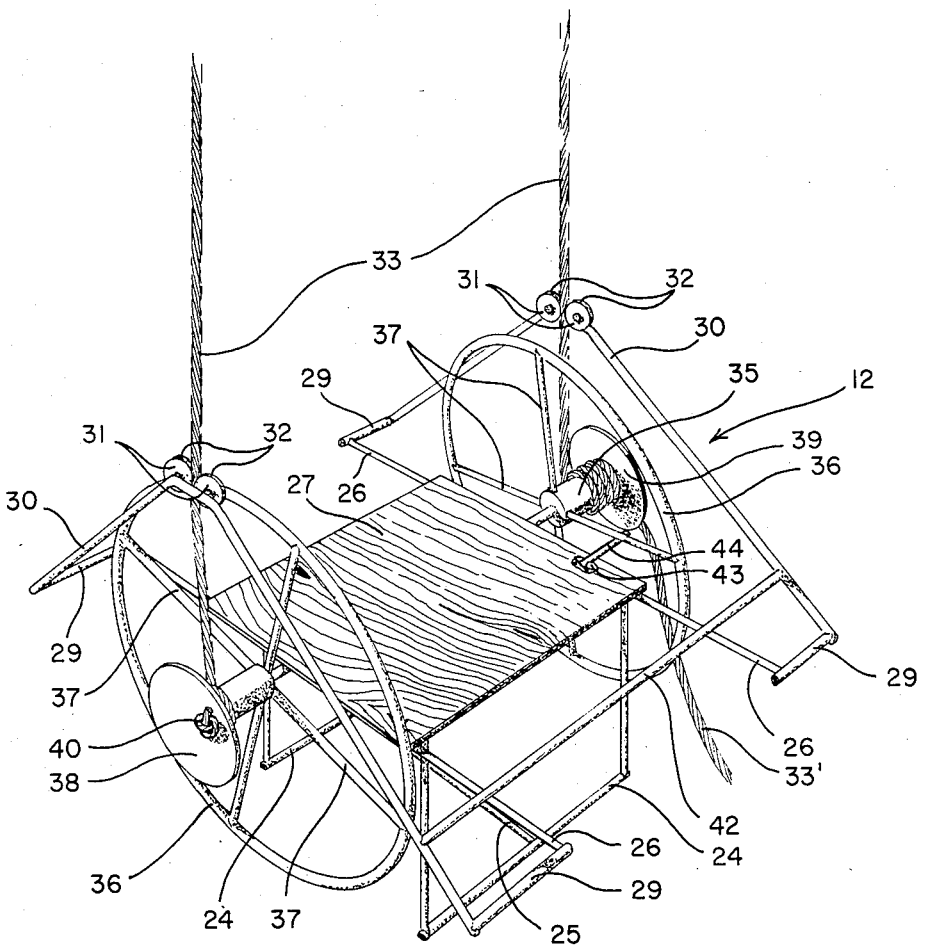
FIG. 2 is a perspective view of the work platform portion thereof.
Figure 1:
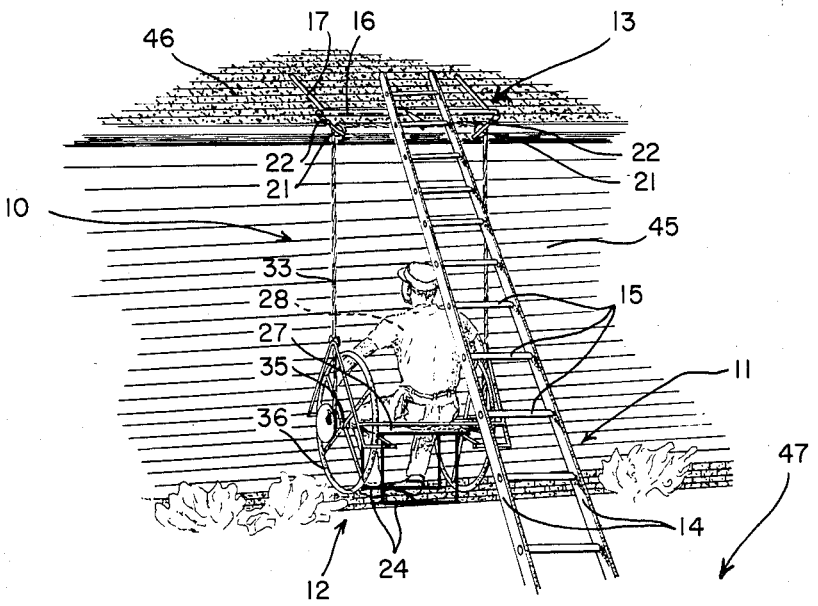
FIG. 1 is a perspective view of the elevatable work station of the present invention.

With further reference to the drawings, the elevatable work station of the present invention, indicated generally at 10, includes a support portion, indicated generally at 11 and a work platform portion, indicated generally at 12.

A support harness portion, indicated generally at 13, operatively interconnects the support portion 11 and the work platform 12.

The support portion 11 of the present invention is preferably in the form of a conventional runged ladder or conventional extension ladder, the only difference being one is extensible and one is fixed. The ladder forming a support portion 11 includes standard parallel side members 14 and a plurality of rungs 15 extending therebetween. Since ladders of the type described are well known to those skilled in the art, further detailed discussion of the same is not deemed necessary.

The support harness portion 13 of the present invention includes a spreader bar 16 having a pair of weight distributing arms 17 fixedly secured to and outwardly extending therefrom adjacent the ends of such bar.

A spacer arm 18 is fixedly secured to the central portion of spreader bar 16 on the opposite side from the said weight distributing arms 17. The outer end of spacer arm 18 includes a pair of outwardly disposed fingers 19 which are adapted to nestingly engage one of the rungs 15' of support portion 11.

Figure 6:
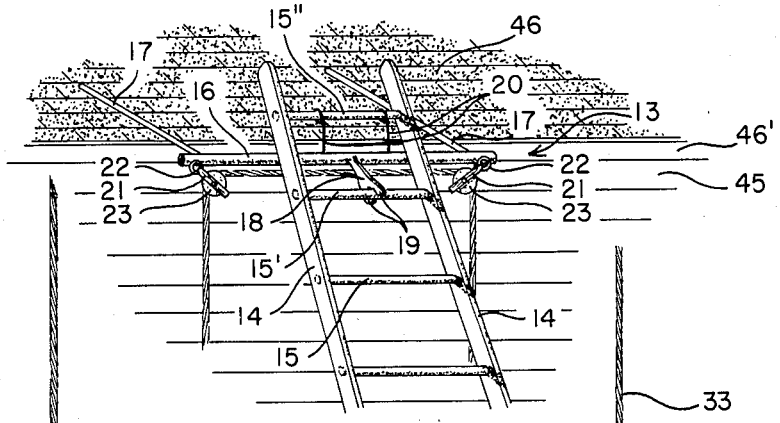
FIG. 6 is a perspective view of the support harness for the work platform.
Figure 3:
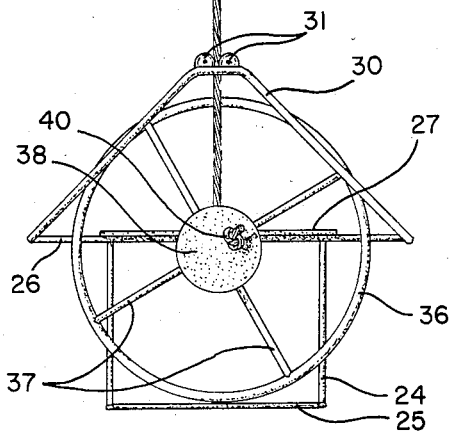
FIG. 3 is a left side elevational view thereof.
Figure 4:
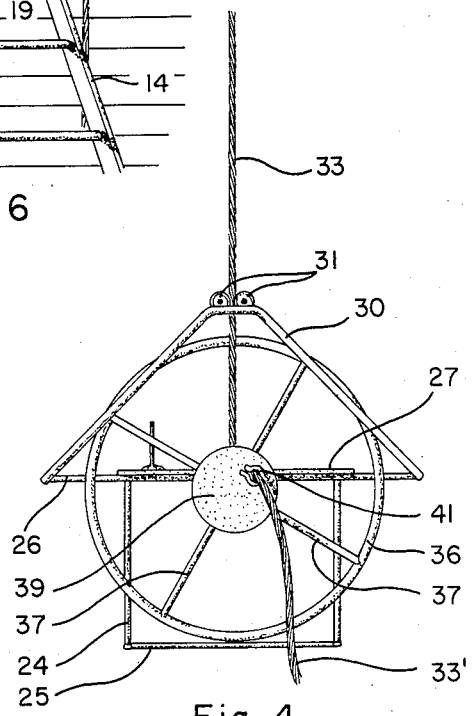
FIG. 4 is a right side elevational view thereof.

Securing means 20 engage rung 15" immediately above rung 15' at opposite ends thereof juxtaposed to side members 14 as can clearly be seen in FIG. 6. The opposite end of each of the securing means 20 from rung 15" is connected to spreader bar 16.

A pair of blocks 21 are secured through swivel connections 22 to opposite ends of spreader bar 16. Each of the blocks 21 rotatively mounts a sheave or pulley wheel 23. Since blocks and swivel connections of this type are well known to those skilled in the art, further detailed discussion of the same is not deemed necessary.

The work platform portion 12 of the present invention includes a pair of parallelly disposed u-shaped support frames 24 which are connected by cross frame 25 at the bottom thereof. Horizontally disposed support arms 26 interconnect the upper ends of said parallelly disposed support frames 24.

A platform 27 is mounted on and between the horizontally disposed support arms 26 and is adapted to support not only paint, tools, and the like, but also the worker 28 using the same.

Opposite ends of support arms 26 extend outwardly from platform 27. Horizontally disposed spacer arms 29 are fixedly secured to and outwardly extend at a ninety degree angle from each of the ends of the support arms 26 as can clearly be seen in FIG. 2.

A pair of inverted V-shaped guide arms 30 are fixedly secured to and extend between the ends of paired spacer arms 29 opposite support arms 26.

A pair of guide wheels 31 are rotatively mounted at the peak of each of the guide arms 30. Each of these guide wheels are similar to pulley sheaves and have concave perpharies as indicated at 32 thus allowing free movement of support line 33 between such paired guide wheels while preventing said line from becoming disengaged therefrom.

A support axle 34 is rotatively mounted to support arms 26 below platform 27. A line take-up drum 35 is fixedly secured to each end of support axle 34.

Relatively large hand manipulated lifting wheels 36 are mounted on the outer ends of a plurality of spokes 37 which are fixedly secured to support axle 34 juxtaposed to one end of takeup drum 35. The opposite ends of drums 35 have guide plates 38 or 39 fixedly secured thereto.

An opening is provided in guide plate 38 adjacent takeup drum 35. One end of support line 33 is passed through such opening and can be knotted or otherwise secured to the outside of such plate as indicated at 40. Support line 33 is then trained through the first set of guide wheels 31, over the sheaves 23 of blocks 21, and back down between the other pair of guide wheels to the take-up drum 35 on the opposite side of work platform 12. The support line is then passed through an opening in guide plate 39 adjacent take-up drum 35 and is releasably secured to the outside of such plate. Although a simple knot could be used for this releasable connection, quick release line securing means 41 such as tailing line clutches which tightly hold the line and yet are readily releasable are preferred. Cam cleats, jam cleats, rope clutches, and sheet stoppers are just a few examples of well known, readily available releasable line securing means. Since these various securing means are all commercially available, further detailed discussion of the same is not deemed necessary.

Figure 5:
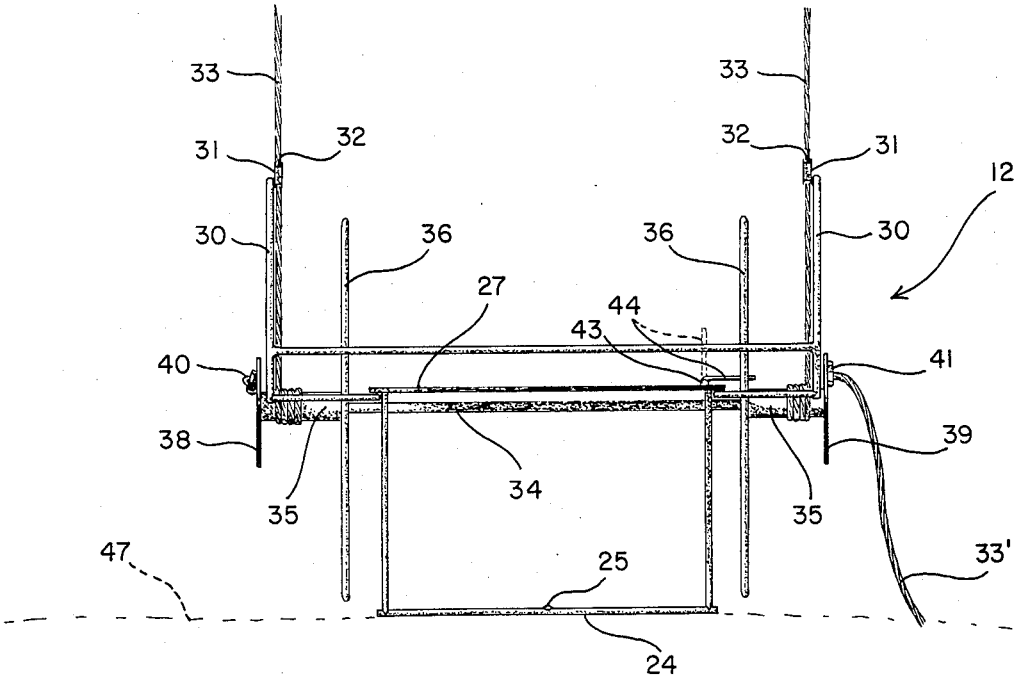
FIG. 5 is a rear elevational view thereof.

A reinforcing cross bar 42 extends between and is secured to guide arms 30 as can clearly be seen in FIGS. 2 and 5.

At least one latch base 43 is fixedly secured to platform 27 adjacent one of the lifting wheels 36. A latch pawl 44 is pivotively secured to latch base 43 so that it can be moved upwardly as shown in dotted lines in FIG. 5 or can be pivoted to the horizontal position shown to engage one of the spokes 37 of hand wheel 36. Thus it can be seen that the pawl will automatically allow the spokes to turn when the support line 33 is being wound on take-up drum 35 but will stop spoke movement in the opposite or unwinding direction. Line 33 can be wound around drum 35 with locking pawl 44 preventing accidental unwinding thereof thereby leaving the worker's hands free to do the assigned task.

When it is desired to lower the platform portion 12 of the present invention, the locking pawl 44 is simply flipped back out of the plane of travel of the spokes 37 and the hand wheels 36 grasped to gently unwind the line from the drums to lower the work platform to the next desired area. When a stop location is reached, the pawl is simply flipped back to horizontal so that it will lockingly engage the next spoke to pass thereby.

To use the elevatable work station of the present invention, the support harness 13 is connected to support 11 by placing securing means 20 over one of the rungs thereof with the spacer 18 engaging an adjacent lower rung.

Support line 33 of a suitable material and strength to support work platform 12 and its occupant is secured to guide plate 38 and wrapped around the adjacent take-up drum 35 at least one revolution. The support line is then trained between the adjacent guide wheels 31 of adjacent guide arm 30, over the sheaves 23 of blocks 21 at opposite ends of spreader bar 16, and back through the second pair of guide wheels and around the takeup drum 35 adjacent guide plate 39. The line is then trained through such guide plate into the releasable line securing means 41. The tail of support line 33 is then simply allowed to hang loose or can be coiled and hung from a convenient portion of the work platform 12 such as cross bar 42.

Next the support harness 13 is attached to one of the rungs 15 of support portion 11 through securing means 20 with spacer arm 18 engaging an adjacent lower rung. The support portion 11 and its attached support harness 13 are moved into the desired position adjacent structure 45 with the weight distributing arms 17 lying juxtaposed to the roof 46 of such structure with blocks 21 disposed over the edge 46 of such roof. The bottom portion of the U-shaped support frames 24 support the work platform portion 12 on the ground 47 with the hand wheels 36 being clear thereof as can be seen in the Figures, particularly FIG. 5.

Next the releasable line securing means 41 is engaged to secure the line to guide plate 39. This compensates for difficult heights between support harness 13 and the ground 47. The worker 28 then flips the pawl 44 to the horizontal or spoke-engaging position and sits down on platform 27. Such worker can then rotate the hand wheels 36 forwardly and downwardly with the pawl allowing to pass and then engaging each successive spoke 37.

Once the desired height above the ground 47 has been reached (which can be anywhere from adjacent the edge 46' of roof 46 to just off the ground 47) the hand wheel can simply be released and the pawl 44 will engage the first spoke 37 to move adjacent thereto and hold the entire work platform portion 12 in the desired elevated position.

The worker can then paint, scrape, sandblast, etc., the area immediately in front of him as well as at arms length on either side thereof. Once the job being accomplished in the area has been completed, the pressure can be taken off pawl 44, and using the hand wheels 36 as a brake, support line 33 can be allowed to wind off of drums 35 on opposite sides of the work platform 12. Once the desired new work area has been reached, the pawl is simply moved back into the locking position and the worker 28 proceeds as before.

The above process can be repeated as many times as necessary to accomplish the desired work along the entire distance from the roof 46 to the ground 47 of structure 45. The support 11 can then be moved to an adjacent location and the entire work sequence repeated for the next up and down swath.

Although the sequence described above was for an up to down sequence, it is, of course, just as practical to reverse the procedure.

Once the entire job has been completed as described above, the elevatable work station of the present invention can be disassembled into its three primary portions and compactly stored until next needed.

As an added safety feature, a centrifical clutch can be added to the present invention between the drum 35 and the fixed portion of the work platform 12 so that should too rapid descent be encountered, the clutch will engage to slow the descent to a pre-determined rate or stop the descent entirely. Since devices of this type are well known to those skilled in the art, further detailed discussion of the same is not deemed necessary.

From the above, it can be seen that the present invention has the advantage of providing a relatively simple and yet highly efficient means of providing an elevated work station which can be readily moved upwardly and downwardly with a minimal of effort. A large swath of work area can be covered before movement of the support portion is required. Additionally the present invention is relatively inexpensive and yet is safe to use and can be readily stored.

The present invention can, of course, be carried out in other specific ways than those herein set forth without departing from the spirit and essential characteristics of the invention. The present embodiments are, therefore, to be considered in all respects as illustrative and not restrictive and all changes coming withing the meaning and equivalency range of the appended claims are intended to be embraced therein.

What is claimed is:

1. An elevated work station comprising: a portable support means; a work platform having a pair of take-up drums rotatively mounted on opposite sides thereof, said take up drums having a common axis of rotation extending transversly beneath said work platform; a pair of line-like means extending between said support means and said work platform for suspending said work platform at an elevated position relative to the ground, each said line-like means being wound about a respective take-up drum; rotation prevention means extending upwardly from said work platform to a point above and in alignment with said take up drums for engaging said line-like means and preventing said work platform from rotating about said axis of rotation of said take-up drums thereby maintaining said work platform in a level position relative to the ground; and means for rotating said take-up drums wheeby said work station can be controllingly moved upwardly and downwardly.

2. The elevatable work station of claim 1 wherein said portable support means is a ladder type device.

3. The elevatable work station of claim 2 wherein said ladder is of the extension type.

4. The elevatable work station of claim 1 wherein said rotatively mounted take-up drums on opposite sides of said work platform are interconnected.

5. The elevatable work station of claim 4 wherein the means for interconnecting said take-up drums is a support axle means extending from one side of said work platform to the opposite side thereof.

6. The elevatable work station of claim 4 wherein at least one of said take-up drums is hand rotatable.

7. The elevatable work station of claim 6 wherein said hand manipulated take-up drum is an enlarged hand wheel operatively secured to said drum means.

8. The elevatable work station of claim 1 including means for preventing rotation of said take-up drum whereby said work platform can be held at a desire elevated location.

9. The elevatable work station of claim 8 wherein the means for preventing the rotation of said drum is a pawl type locking means.

10. The elevatable work station of claim 1 including a releasable line securing means operatively associated with at least one of said take-up drums whereby the length of said line-like means can be adjusted.

11. The elevated work station of claim 1 wherein said line engaging means include a pair of frame structures extending upwardly from opposite sides of said work platform, each said frame structure having a pair of guide rollers rotatively mounted thereon for engaging a corresponding line-like means, said pair of guide rollers being disposed on opposite sides of said line-like means and having an axis of rotation generally parallel to the axis of rotation of said take-up drums.

* * * * *